US007187777B1

(12) United States Patent
Saffran

(10) Patent No.: US 7,187,777 B1
(45) Date of Patent: Mar. 6, 2007

(54) SOUND REPRODUCING SYSTEM SIMULATING

(75) Inventor: Richard E. Saffran, Brookline, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 08/440,073

(22) Filed: May 12, 1995

(51) Int. Cl.
*H04R 5/02* (2006.01)

(52) U.S. Cl. ..... 381/306; 381/333

(58) Field of Classification Search ..... 381/24, 381/27, 87, 90, 188, 205, 61, 63, 17, 18, 381/310, 304, 301, 306, 332, 333
See application file for complete search history.

(56) References Cited

U.S. PATENT DOCUMENTS

| | | | | |
|---|---|---|---|---|
| 3,236,949 A | | 2/1966 | Atal et al. | |
| 3,970,787 A | * | 7/1976 | Searle | 381/310 |
| 4,107,461 A | * | 8/1978 | Bose | 381/300 |
| 4,227,047 A | * | 10/1980 | Horne | 381/300 |
| 4,893,342 A | | 1/1990 | Cooper et al. | |
| 4,905,284 A | * | 2/1990 | Kwang | 381/27 |
| 4,953,223 A | * | 8/1990 | Householder | 381/24 |
| 4,975,974 A | | 12/1990 | Nishijima et al. | |
| 5,086,755 A | * | 2/1992 | Schmid-Eilber | 128/33 |

OTHER PUBLICATIONS

Bulkekey, William M., "Sound Program Lets User Mimic Site's Acoustics", The Wall Street Journal, Oct. 19, 1994.*

M.R. Schroeder et al., "Comparative study of European concert halls: correlation of subjective preference with geometric and acoustic parameters", Oct. 1974, J. Acoust.Soc. Am., vol. 56, No. 4, pp. 1198-1201.

Henrik Moller, "Reproduction of Artificial Head Recordings through Loudspeakers", Jan./Feb. 1989, J. Audio Eng. Soc., vol. 37, No. 1/2, pp. 30-33.

David Griesinger, "Theory and Design of a Digtial Audio Signal Processor for Home Use", Jan./Feb. 1989, J. Audio Eng. Soc., vol. 37, No. 1/2, pp. 40-50.

Duane H. Cooper et al., "Prospects for Transaural Recording", Jan./Feb. 1989, J. Audio Eng. Soc., vol. 37, No. 1/2, pp. 3-19.

Tomas Salava, Transaural Stereo and Near-Field Listening, Jan./Feb. 1990, J. Audio Eng. Soc., vol. 38, No. 1/2, pp. 40-41.

Jerry Bauck et al., "Generalized Transaural Stereo", Oct. 1-4, 1992, AES Convention, San Francisco, pp. 1-28.

William M. Bulkeley, "Sound Program Lets User Mimic Site's Acoustics", Oct. 19, 1994, The Wall Street, pp. 21-22.

* cited by examiner

*Primary Examiner*—Ping Lee
(74) *Attorney, Agent, or Firm*—Fish & Richardson P.C.

(57) ABSTRACT

Apparatus for simulating sound properties of audio equipment not physically present in a simulated environment not physically present includes a source of binaurally encoded audio signals processed for loudspeaker reproduction characterizing audio equipment not physically present in a simulated environment not physically present. There are left and right electroacoustical transducers. A head locator is constructed and arranged to locate a listener's head in a predetermined position between and a predetermined distance from the left and right electroacoustical transducers so that the electroacoustical transducers are forward of the listener's head. Amplifying apparatus couples the source to the electroacoustical transducers. A selector operable by a listener with head substantially at the position is constructed and arranged to select the audio reproduced by the electroacoustical transducers to furnish that listener with a sound simulation of selected audio equipment not physically present in a selected simulated environment not physically present.

2 Claims, 8 Drawing Sheets

SOUND REPRODUCING SYSTEM SIMULATING

The present invention relates in general to simulating sound system reproduction and more particularly concerns demonstrating the sound performance of audio systems or loudspeaker systems which are not physically present as they would sound in an environment which is not also physically present, and still more particularly to a novel, self-contained demonstration apparatus for transducing by near-field reproduction binaurally encoded signals processed for loudspeaker reproduction, such processing optionally incorporating transaural crosstalk cancellation.

For background, reference is made to U.S. Pat. No. 4,893,342 entitled HEAD DIFFRACTION COMPENSATED STEREO SYSTEM and a paper of David Griesinger entitled "Theory and Design of a Digital Audio Signal Processor for Home Use" in J. Audio Eng. Soc., Vol. 37, No. 1/2 1989 January/February p. 40, which refers to work of Schroeder using interaural crosstalk elimination to play binaural recordings made in actual concert halls. Reference is also made to papers of M. R. Schroeder et al. entitled "Comparative study of European concert halls: correlation of subjective preference with geometric and acoustic parameters" in J. Acoust. Soc. Am., Vol. 56, No. 4, October 1974 p. 1195, of Moller entitled "Reproduction of Artificial-Head Recordings through Loudspeakers" in J. Audio Eng. Soc., Vol. 37 No. 1/2 1989 January/February p. 30, of Cooper et al. entitled "Prospects for Transaural Recording" in J. Audio Eng. Soc. Vol. 37, No. 1/2, 1989 January/February p. 3, of Jerry Bauck and Duane H. Cooper entitled "Generalized Transaural Stereo and Applications," presented at the 20th Convention of the Audio Engineering Society, San Francisco, October 1992, U.S. Pat. No. 3,236,949 entitled APPARENT SOUND SOURCE TRANSLATOR, U.S. Pat. No. 4,975,974 entitled HEAD DIFFRACTION COMPENSATED STEREO SYSTEM WITH OPTIMAL EQUALIZATION, and the letter of Salava entitled "Transaural Stereo and Near-Field Listening" in J. Audio Eng. Soc., Vol. 38, No. 1/2 1990 January/February p. 40. Reference is also made to an article in THE WALL STREET JOURNAL for Oct. 19, 1994, describing the Bose AUDITIONER sound demonstrating system and the publicly available Bose loudspeaker demonstrator that allows users to select actual loudspeaker equipment for a listening demonstration.

It is an important object of this invention to provide improved apparatus and techniques for demonstrating audio equipment or other sound sources in varying acoustic environments without that equipment, other sound source, or environment actually being present.

A feature of the invention is that it allows those seeking to purchase audio equipment or those interested in hearing demonstrations of sound producing or sound reproducing equipment to obtain the desired demonstrations without the usual constraints of space and equipment setup. For example, an audio equipment retailer may not have sufficient space to demonstrate several models of loudspeakers; or the space available may not be satisfactory for such demonstrations because of room acoustics or background noise. This invention is not subject to these limitations, and also makes it possible to obtain repeatable and accurate sound demonstrations in locations previously unsuitable for such demonstrations. Furthermore, the invention allows demonstrating how selected audio equipment would sound in a room very much like the listener's room at home.

According to the invention, there is a source of binaurally encoded signals processed for loudspeaker reproduction in a manner that achieves a fully realistic, three-dimensional auditory illusion for a single listener, that is externalized from the listener's head and that is nearly indistinguishable from the listening experience that would be perceived were the listener to be listening to the actual sound source in the actual environment that the system is simulating. The various means to create binaurally encoded signals and process them for loudspeaker reproduction are known to those skilled in the art. An exemplary method employing filtering to cancel unwanted acoustic signal crosstalk between the left and right ears is described in U.S. Pat. No. 4,975,954 entitled HEAD DIFFRACTION COMPENSATED STEREO SYSTEM WITH OPTIMAL EQUALIZATION, pages 1–3.

According to a specific feature of the invention, there is a selector that allows the listener to select specific audio equipment, such as a specific loudspeaker system, to be simulated. According to another feature of the invention, there is a simulated environment selector that allows the listener to select the environment in which the sound performance of the selected audio equipment is to be simulated. More specifically, the environment selector allows the listener to specify the most important characteristics of a selected listening room so as to allow an auditory experience to be produced by the invention which is very close to that which would be experienced in the actual selected listening room with the actual selected audio equipment playing there. According to another feature of the invention, there is a sound source selector that allows the listener to select the program material, typically music, to be heard over the simulated selected audio equipment in the simulated selected listening room.

According to another feature of the invention, there is structure constructed and arranged to comfortably and accurately locate the listener so that the head of the listener is within the range of correct locations relative to a pair of electroacoustical transducers reproducing the processed binaural signal such that the listener perceives an accurate simulated auditory experience. According to another feature of the invention, there is an enclosure providing partial acoustic isolation of the listener from the surrounding environment so as to reduce the distracting effects of background noise. A further feature includes construction so as to reduce the sound level of the simulated demonstration in the area surrounding the apparatus so as not to disturb others outside the apparatus.

According to another aspect of the invention, there is a visual display synchronized with the auditory demonstration that may provide additional information and furnish a pictorial representation of the simulated environment. Preferably, the electroacoustical transducers are concealed so as to further enhance the illusion that the listener is perceiving sound from loudspeakers in an environment not physically present.

Other features, objects and advantages of the invention will become apparent from the following detailed description when read in connection with the accompanying drawing in which.

Figure 2:
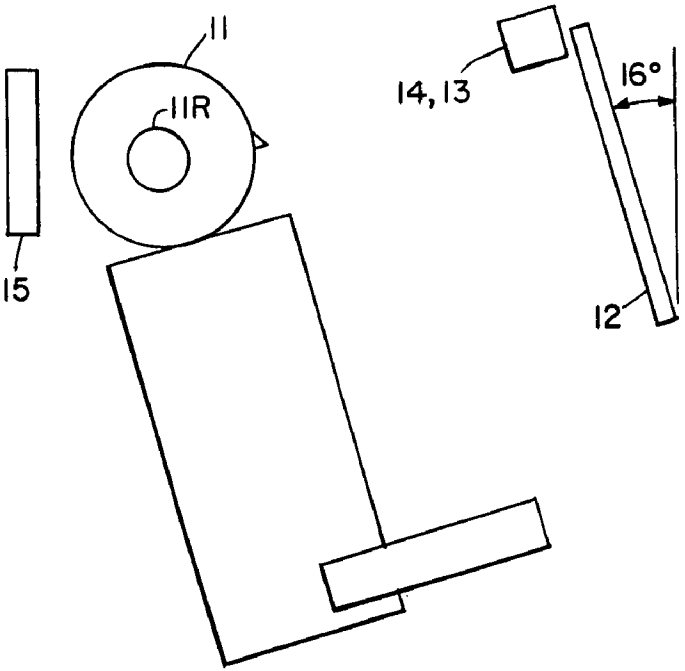
FIG. 2 is an elevation view of the embodiment of FIG. 1.
Figure 1:
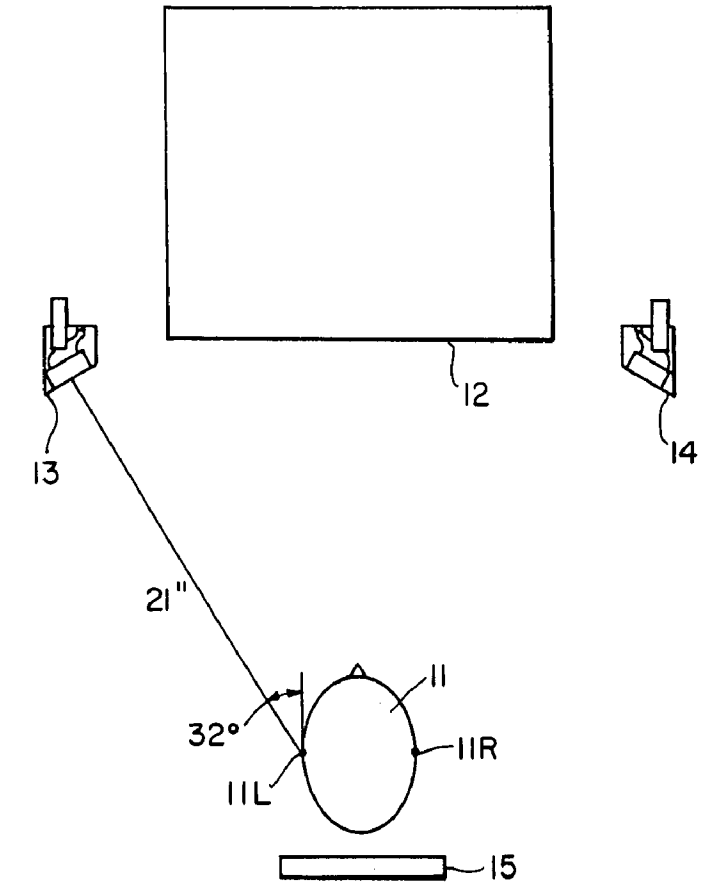
FIG. 1 is a pictorial diagrammatic plan view of an embodiment of the invention.

With reference now to the drawings and more particularly FIGS. 1 and 2 thereof, there are shown plan and elevation views, respectively, of a diagrammatic pictorial representation of an embodiment of the invention. A listener 11 is shown positioned as shown with left and right ears 11L and 11R, respectively, facing screen 12, typically 16 inches away, and left and right small wide-range electroacoustical transducers 13 and 14, respectively, typically covering the frequency range from substantially 200 Hz to substantially 20,000 Hz typically 28 inches from an associated ear along a respective transducer axis that typically makes an angle of 45° with the normal to screen 12 in ported enclosure typically tuned to 175 Hz, just below the 200 Hz crossover. A suitable acceptable range of the angle between a transducer axis and normal to screen 12 is 10° to 80°. Woofer 15 is typically located behind listener 11 and may comprise a thin 8" long-throw driver unit mounted directly behind the head of listener 11 so that listener 11 is in the near field and is typically mounted in a small baffle which is effectively open in the woofer operating range below 200 Hz. This arrangement furnishes significant cancellation in the far field so that for a given sound pressure level (SPL) at the listener's head, the SPL away from the listener is lowered by 10 DB or more compared to the SPL away from the listener produced by a woofer operating in an enclosure. It is also within the scope of this invention to provide an audio signal transduction system without woofer 15 or crossover networks 25L and 25R or summing circuit 26 or woofer amplifier 27 or woofer equalizer 28. Instead the entire audio frequency range may be transduced by left and right transducers 13 and 14.

A floor marker 16 may indicate a listening position. A vertically adjustable mounting 17 for electroacoustical transducers 13 and 14 comprises a vertical position adjuster operable by a listener. A visual identifier 18 visually indicates to the listener when the electroacoustical transducers are at a predetermined vertical location with respect to the listener's head.

Alternatively, a listener head location sensor 19 may provide a signal to vertical position adjuster 17 for automatically adjusting the vertical position of the transducers to a predetermined vertical position in response to a signal from logical circuitry 20 responsive to the listener head location signal for actuating the vertically adjustable mounting to position the electroacoustical transducers at a predetermined vertical position related to the listener head position.

In another embodiment of the invention, there are more than two speakers to cover the audio range or to cover the upper frequency audio range, with each speaker typically driven by its own amplifier and each amplifier typically being supplied with a separate signal source. A technique describing how to process two audio input channels, such as the two channels included in a commercially available stereo recording, into the multiplicity of audio signals, one for each of the more than two loudspeakers, for producing the full three-dimensional auditory illusion is described in "Generalized Transaural Stereo and Applications" by Jerry Bauck and Duane S. Cooper identified above. It is an advantage of such a technique to provide improved control over the auditory illusion over an extended listening area, possibly allowing more than one person to use the invention at a time.

Figure 3:
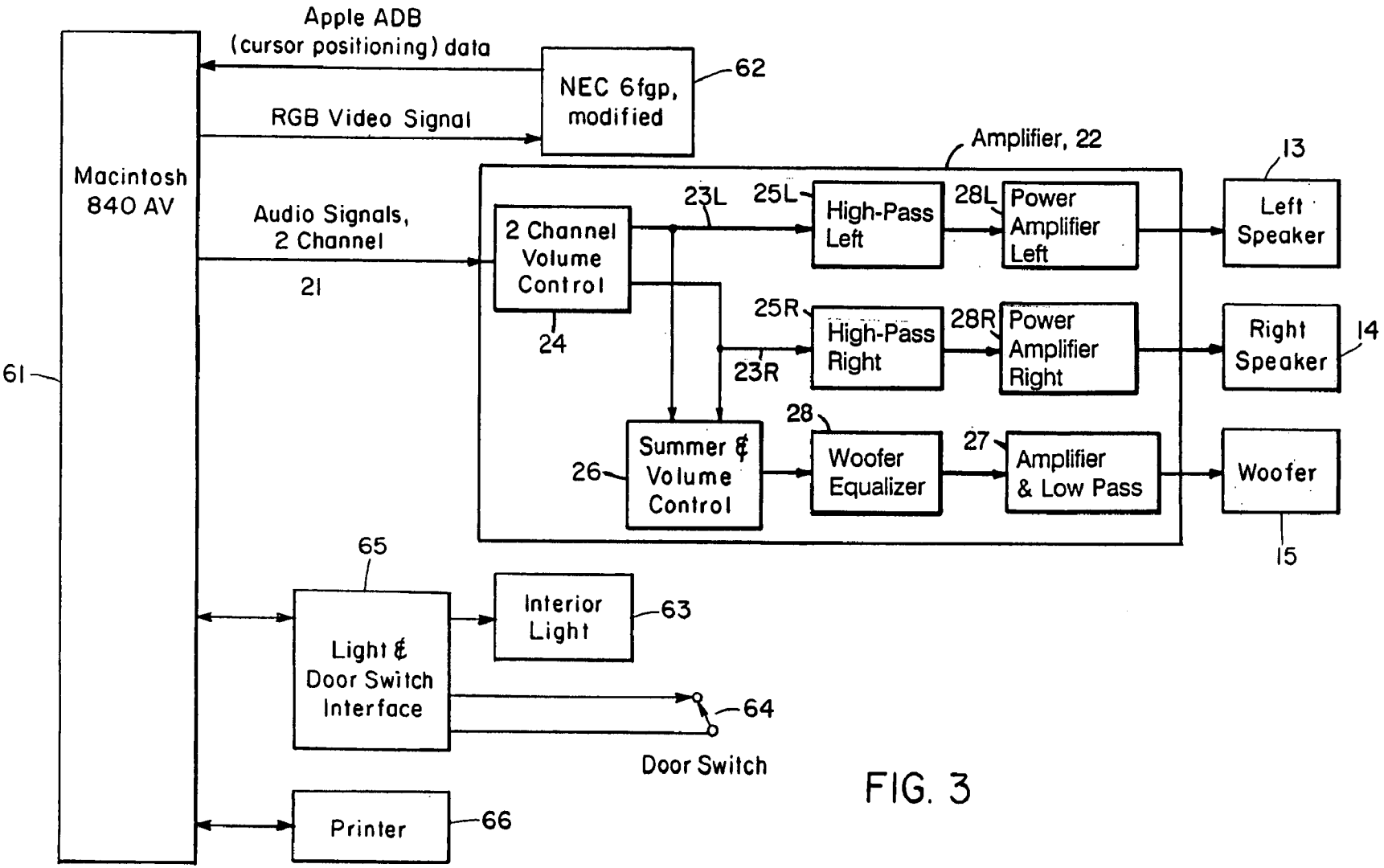
FIG. 3 is a block diagram illustrating the logical arrangement of a system according to the invention.

Referring now to FIG. 3, there is shown a block diagram illustrating the logical arrangement of a system according to the invention. A signal source 21 furnishes left and right binaurally encoded signals processed for loudspeaker reproduction to amplifier 22 having left and right inputs 23L and 23R, a ganged volume control 24, left and right crossover networks 25L and 25R, a summing circuit 26 that combines the bass signals, a woofer amplifier 27, typically preceded by an equalizer, typically a Bose switching amplifier for woofer 15, and left and right amplifiers 28L and 28R for driving left and right upper frequency transducers 13 and 14, respectively. It may be advantageous to use equalizers which frequency equalize the left and right signals. It may also be advantageous to use a Bose amplifier and Crown D75 amplifier to furnish higher voltage levels for transducers 13 and 14 when the transducers are 4 ohm or 8 ohm speakers.

A computer 61, such as a Macintosh 840AV, typically furnishes the audio signals on source lines 21 and the RGB video signal to monitor 62, typically an NEC 21" diagonal RGB monitor with touch screen fitted to bezel and Apple ADB interface to provide Apple ADB cursor positioning data to computer 61. There is an interior light 63 and door switch 64 that exchange signals with computer 61 through light and door switch interface 65. Computer 61 is also coupled to printer 66 to allow printout of desired information.

Figure 4:
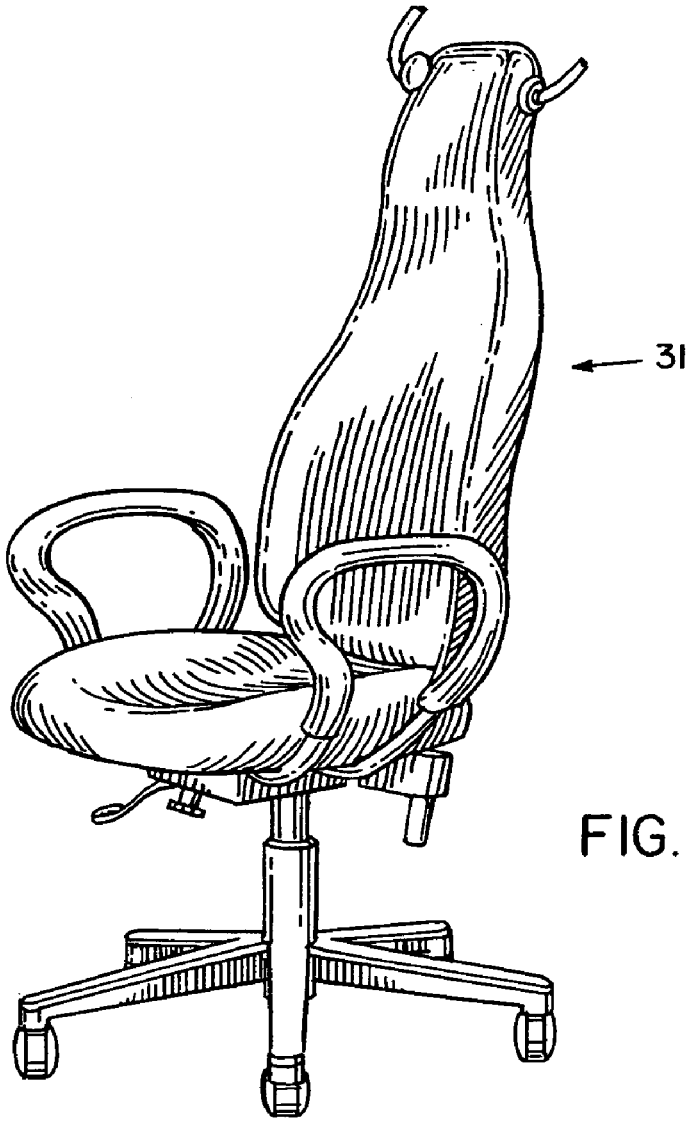
FIG. 4 is a perspective view of a chair comprising a head locator.

Referring to FIG. 4, there is shown a perspective view of a swiveling tilting office chair 31 comprising a head locator, typically comprising a Global model Obus Forme swiveling tilting office chair. The back tilt tension is set very low and the seat bottom has a fixed tilt so that when the listener sits, the listener is inclined to lean back in the seat. The amount of tilt back is small, typically about 2 inches, until the seat top hits the back wall of the enclosing booth. The seat includes an adjustable cushion which may be moved up or down by the listener so that the listener's head is comfortably supported when the chair is tilted back with the listener seated. The seat top back nestles between two stops 31A and 31B so that the listener's head is pointing toward display screen 12 and located along an axis position vertically with respect to left and right transducers 13 and 14 and always equidistant from and positioned directly between these two transducers. The locations of transducers 13 and 14 and chair 31 are arranged so that the median height person is directly on the axis of the transducers, with equal variation above and below that position for taller and shorter persons. Seated ear height variation is about a half of population standing height variation.

Figure 5A:
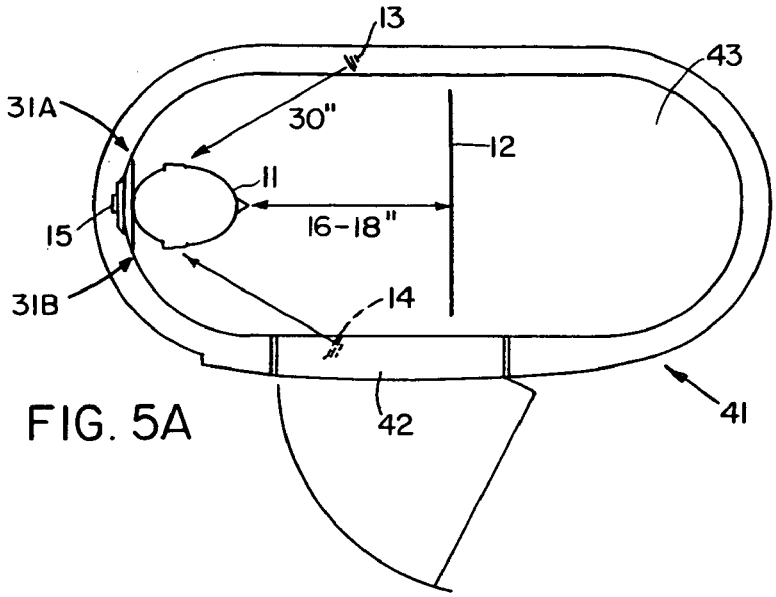
FIGS. 5A and 5B are plan and elevation views, respectively, of an embodiment of the invention including a booth.
Figure 5B:
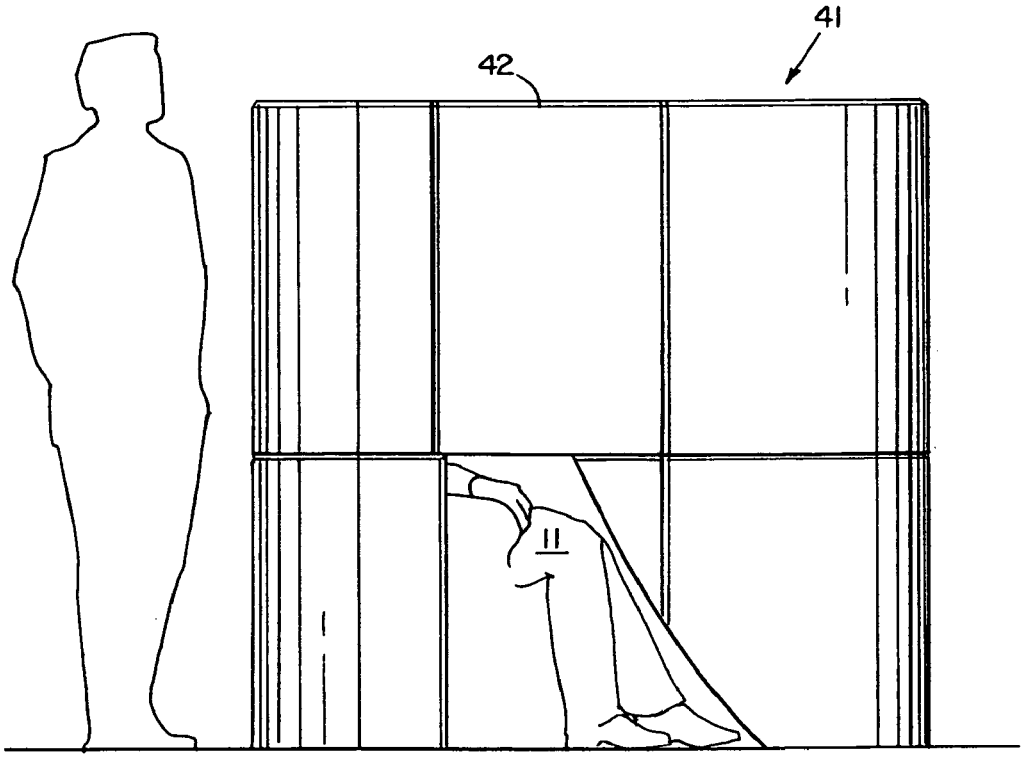

Referring to FIG. 5A, there is shown a plan diagrammatic view of an embodiment of the invention comprising a booth 41 constructed and arranged to fully enclose listener 11. Booth 41 is open on the top and on the bottom of entrance door 42 as best seen in the elevation view in FIG. 5B. Typical dimensions are approximately 30" wide by 48" deep on the inside, just enough room to seat one listener and allow chair 31 to swivel for easy entrance and exit. Electroacoustical transducer 14 is mounted in hinged door 42. Electroacoustical transducer 13 is mounted in the opposite wall. Woofer 15 is mounted in the wall behind listener 11. Electroacoustical transducers 13 and 14 and woofer 15 are preferably mounted in booth 41 to be completely hidden from view by listener 11. Booth 41 also has a large storage space 43 at the front to hold screen 12 and the electrical apparatus. Screen 12 typically comprises an NEC 6 fgp color 21" diagonal computer monitor.

Figure 6A:
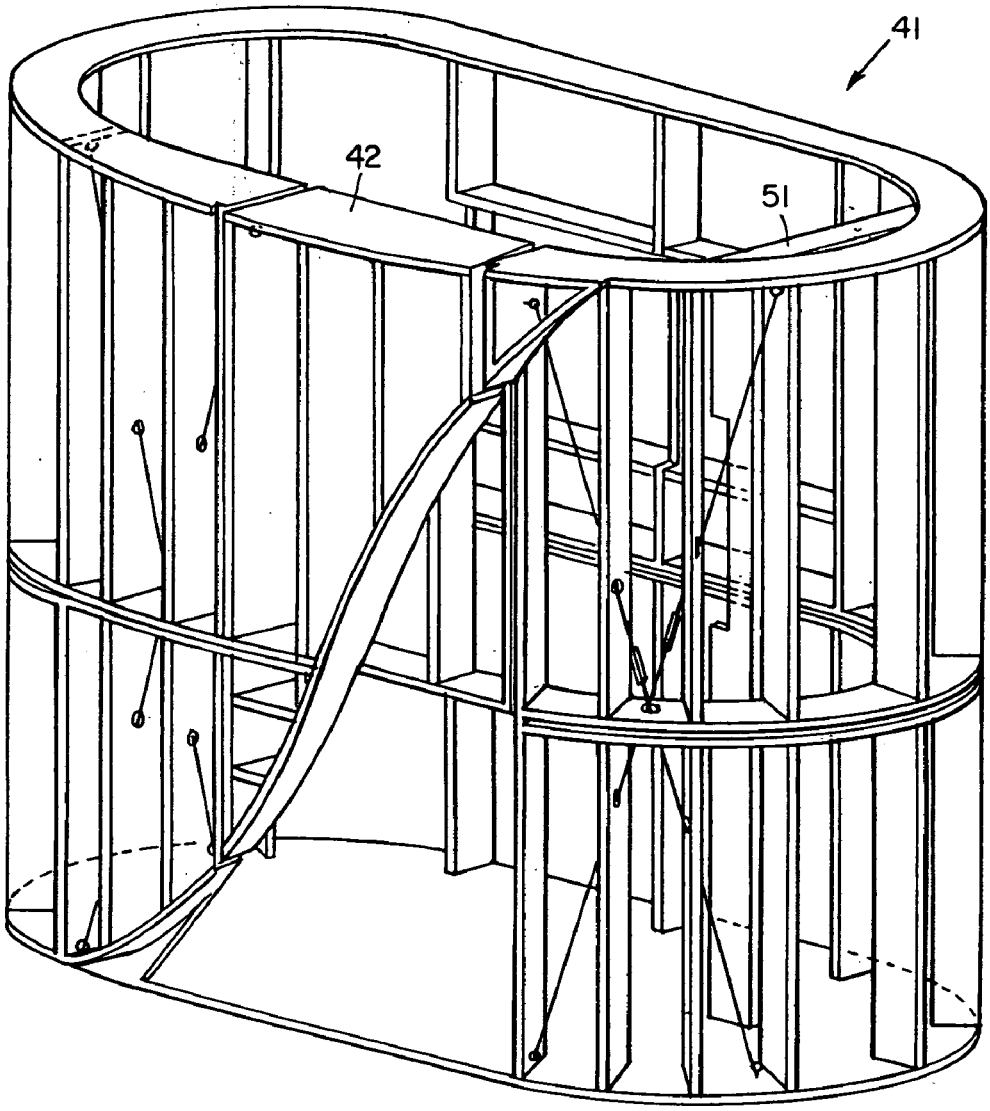
FIGS. 6A–6K are views of the frame and portions thereof of a suitable booth for accommodating all of the components of the system.
Figure 6C:
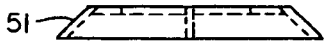
Figure 6B:
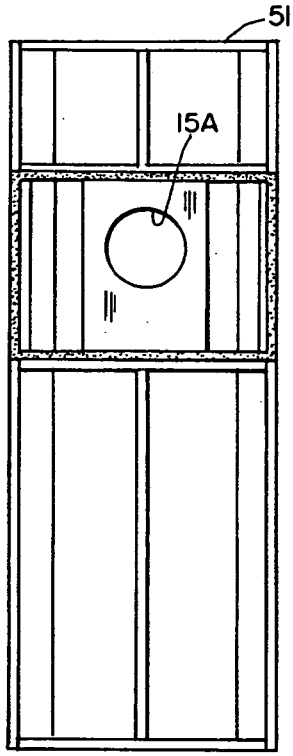
Figure 6D:
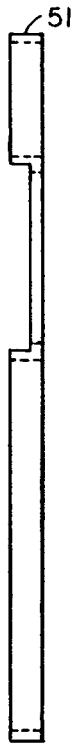

Referring to FIG. 6A, there is shown a perspective view of the frame of booth 41 for accommodating all the components of the system. Referring to FIGS. 6B, 6C and 6D, there are shown front elevation, plan and side elevation views, respectively, of the woofer panel 51 located behind listener 11 that supports woofer 15 in woofer opening 15A.

Figure 6E:
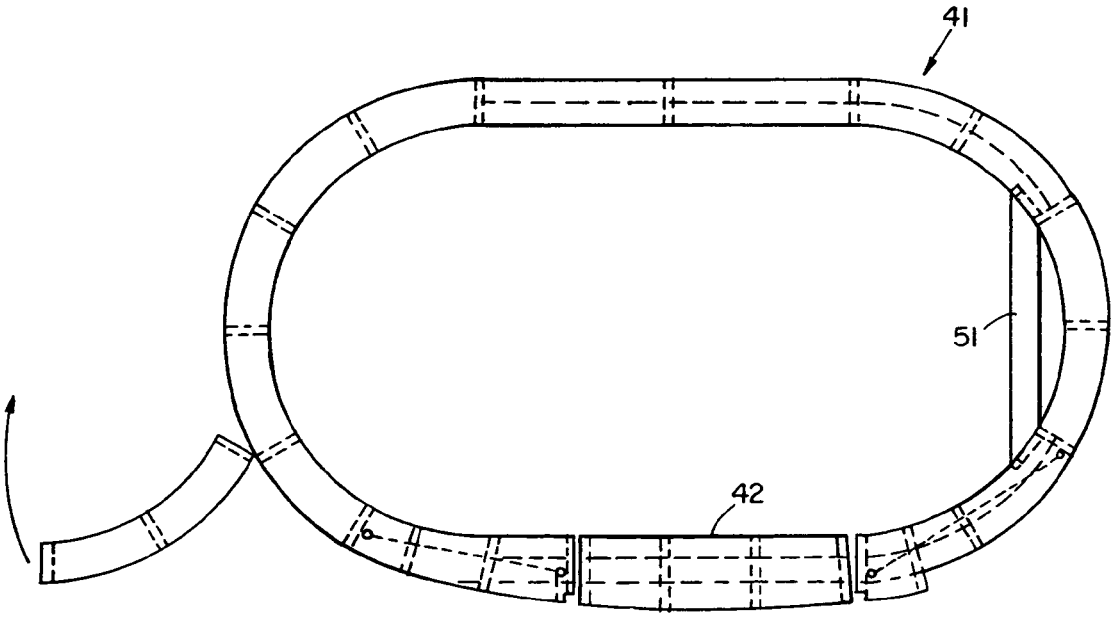
Figure 6F:
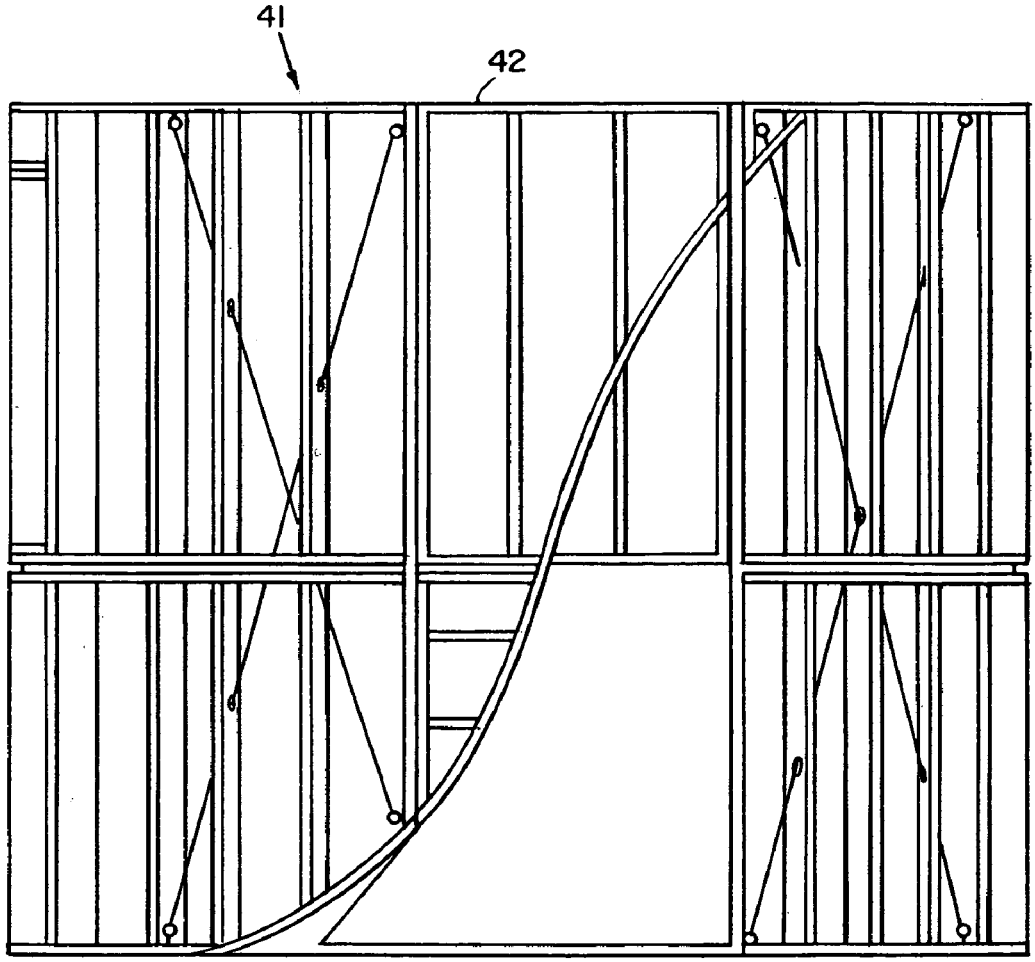

Referring to FIGS. 6E and 6F, there are shown plan and side elevation views, respectively, of the frame of booth 41.

Figure 6G:
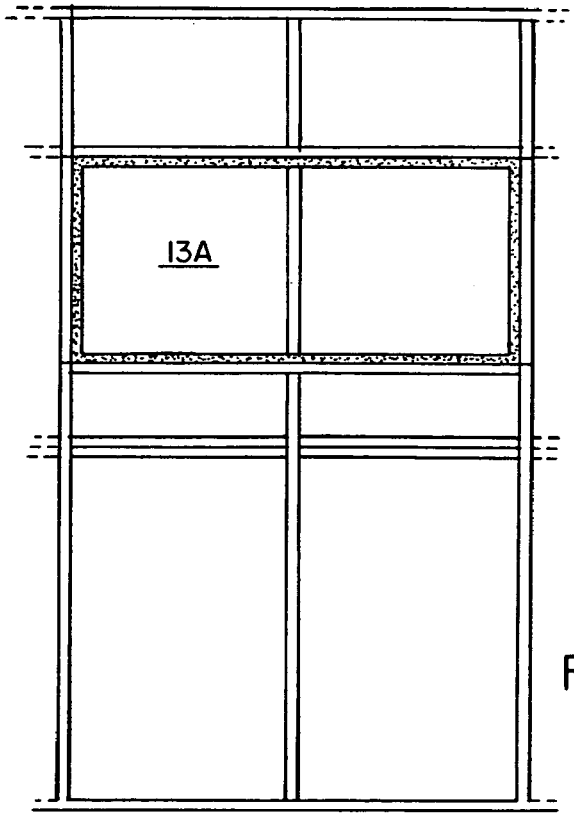
Figure 6H:
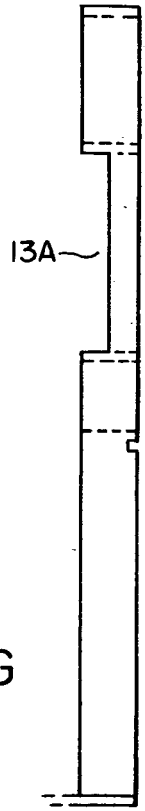

Referring to FIGS. 6G and 6H, there are shown side elevation and edge elevation views of the opposite wall showing the location 13A for mounting transducer 13.

Figure 6J:
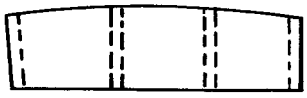
Figure 6I:
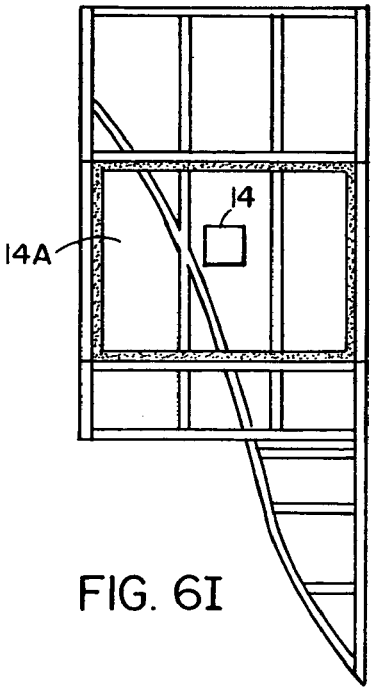
Figure 6K:
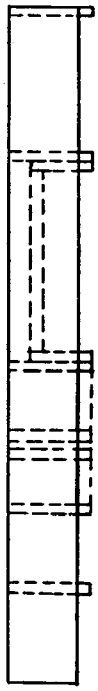

Referring to FIGS. 6I, 6J and 6K, there are shown inside side elevation, plan and edge elevation views, respectively, of door 42 showing the location 14A for mounting electroacoustical transducer 14.

It is also within the scope of this invention to provide other means for locating the listener's head so that the listener experiences the full three-dimensional auditory illusion. An example of such a head-locating means is embodied in the Bose Auditioner Audio Demonstrator incorporated herein by reference comprising, for example, a chin rest on a base unit that supports left and right loudspeakers.

Another approach for locating the listener's head is to mount speakers 13, 14 and woofer 15 at substantially 5'8" above the floor and provide a marked area 16 (FIG. 2) on the floor substantially 18" in front of the speakers with a horizontal bar 16A (FIG. 2) substantially 3' above the floor directly behind the marked floor location so that the listener, when standing on the marked floor location and partially resting on or pressed against the bar, is in the proper location to experience the fully realistic three-dimensional auditory illusion.

It is also within the scope of the invention to provide means for adjusting the vertical position of speakers 13 and 14 so as to be aligned on the same horizontal plane as the listener's ears. Such an adjustment may be made by the listener pressing "up" or "down" buttons until a narrowly focused light is visible at eye level; or with an automatic infrared or ultrasonic range-finding sensor of the type used in an auto-focus camera connected to a control and logic circuit that measures the vertical position of the listener's head and ears and adjusts the speaker height accordingly.

Screen 12 is preferably a touch sensitive screen coupled to multimedia software such that at various stages in the presentation, the software controls the display to insert a pause allowing the listener to make a choice, such as the specific equipment being simulated or the specific environment simulated in which the simulated equipment is being demonstrated.

It is also within the scope of the invention to provide means for listener control comprising a joystick, push buttons or touch sensitive pad located within the reach of the listener's hand. It is also within the scope of this invention to provide a microphone for receiving voice commands of the listener, which commands will be received and acted upon by the computer. Such voice control hardware and software functions are incorporated in the Apple Macintosh model 840AV computer.

The walls of booth 41 are typically made of flexible plywood ¼" thick on a wood stud frame and are typically over 3" thick with the interior space lined with sound-absorbing wedge-shaped foam, such as Sonex made by Illbruck. The walls are further perforated in many places to allow sound to penetrate. The booth is constructed and arranged to pass the sound from each transducer directly into the space within booth 41 and to absorb any of that sound that impinges on any of the interior surfaces of booth 41 so that the surface avoids reflecting sound to the listener. The interior walls of booth 41 are typically lined with speaker grille cloth material, which is acoustically transparent. The top of the booth equipment bay may include a fan for cooling.

The binaurally encoded signals processed for loudspeaker playback may be recorded or synthesized, stored on, for example, a DAT recorder, CD, or on a computer disk. In the exemplary embodiment, a computer disk stores the binaurally encoded signals processed for loudspeaker reproduction and releases them for reproduction under the control of a multimedia authoring software program in the computer that furnishes both audio and video signals and accepts control instructions from the listener activating the touch sensitive screen. A suitable computer is an Apple Macintosh model 840AV with 32 Mb of RAM, 2 Mb video RAM and a 1.7 gigabytes hard disk having built-in digital to analog converters for the left and right binaurally encoded signals. The computer is connected to the monitor touch screen, a switch in the door and a light control interface. The door switch is typically a magnetically normally open single-pole switch single-pole mounted in the door jamb so that when the door is closed, the switch circuit is closed to furnish a signal when the listener enters or exits.

The software controls recovering binaurally encoded audio signals which have been processed for loudspeaker reproduction and video signals representative of graphic images from the storage disk and sends them in synchronism to the amplifiers and to the display monitor. The software also controls computer operation in response to signals from activation of the touch screen control by the listener and selects the audio signals and video signals for reproduction in response to listener selection so as to demonstrate audio equipment, such as speakers, not physically present in an environment that is not physically present.

The software typically includes an idle loop that waits for a listener to enter and close the door and then causes generation of instructions to the listener to be seated, lean back and adjust the cushion behind the listener's neck. The apparatus then furnishes a description of the purpose and function of the demonstration, plays binaurally encoded signals processed for loudspeaker reproduction and displays graphic images to show the listener that the system performs the functions of simulating audio equipment not physically present in an environment that is not physically present. The apparatus then directs the listener to make selections from several screen images to match the characteristics of a desired listening space in which to hear the desired audio equipment. The apparatus then allows the listener to select specific equipment, such as a specific loudspeaker system. The apparatus then allows the listener to select source material, typically music, and causes reproduction of the selected source material through the selected simulated speakers in the selected simulated space. The listener may then make additional choices and comparisons. The apparatus may also include a printer that prints a summary of the experience, the date, the location and the simulated audio equipment or loudspeaker demonstrated. A suitable printer is a Costar model Address Writer printer connected to the computer serial port. The computer is responsive to the door switch state for starting and stopping the presentation and may tabulate listener responses and timing information for market research purposes, and may automatically send such information back to a central location through a wired or wireless communication link.

The booth includes an interior light, typically a fluorescent tube covered with a colored gel that is on when the software establishes an idling state and turns off when a demonstration sequence starts, typically initiated by the listener touching a specific area on the touch screen.

The specific technique for implementing the software is known to those skilled in the art.

There has been described novel apparatus and techniques for simulating audio equipment not physically present as it would sound in an environment not physically present.

Other embodiments are within the claims.

What is claimed is:

1. Apparatus for stimulating sound properties of audio sound reproducing equipment not physically present in a simulated environment not physically present comprising, a source of binaurally encoded audio signals processed for loudspeakers reproduction characterizing selected sound reproducing audio equipment including a loudspeaker system not physically present in a simulated environment not physically present, left and right electroacoustical transducers, a head locator constructed and arranged to locate a listener's head in a predetermined position a predetermined distance from said left and right electroacoustical transducers so that said electroacoustical transducers are forwarded of the listener's head, and amplifying apparatus coupling said source to said electroacoustical transducers, and a selector operable by a listener with head substantially at said predetermined position constructed and arranged to select the audio reproduced by said electroacoustical transducers to furnish that listener with a sound simulation of selected sound reproducing audio equipment including a loudspeaker system not physically present in a selected simulated environment not physically present substantially the same as if that listener were listening to the sound reproducing audio equipment being simulated in the environment being simulated and further comprising a booth containing said electroacoustical transducers, said head locator and said selector, wherein the interior surfaces of said booth are constructed and arranged to absorb sound furnished by said left and right electroacoustical transducers and prevent substantial reflection therefrom by a least one of absorbing sound furnished by said left and right electroacoustical transducers and allowing said sound to pass to the outside of the interior of said booth.

2. Apparatus for simulating sound properties of audio sound-reproducing equipment not physically present in a simulated environment not physically present comprising, a source of binaurally encoded audio signals processed for loudspeaker reproduction characterizing selected sound reproducing audio equipment including a loudspeaker system not physically present in a simulated environment not physically present, left and right electroacoustical transducers, a head locator constructed and arranged to locate a listener's head in a predetermined position a predetermined distance from said left and right electroacoustical transducers so that said electroacoustical transducers are forwarded of the listener's head on the order of 28 inches therefrom, amplifying apparatus coupling said source to said electroacoustical transducers, and a selector operable by a listener with head substantially at said predetermined position constructed and arranged to select the audio reproduced by said electroacoustical transducers to furnish that listener with a sound simulation of selected sound reproducing audio equipment including a loudspeaker system not physically present in a selected simulated environment not physically present substantially the same as if the listener were listening to the sound reproducing audio equipment being simulated in the environment being simulated, and further comprising a floor-standing mounting for said electroacoustical transducers, wherein said head locator comprises one of a floor marker indicating a listening position and a structure in front of said floor-standing mounting establishing a listener location between said structure and said floor-standing mounting, and further comprising a vertically adjustable mounting for said electroacoustical transducers, and further comprising apparatus for automatically adjusting the vertical position of said electroacoustical transducers to a predetermined vertical position including, and further comprising a vertical position adjuster operable by a listener with head in said position to adjust the vertical position of said electroacoustical transducers, and a visual identifier for visually indicating to said listener when said electroacoustical transducers are at a predetermined vertical location with respect to said listener's head, and further comprising a listener head location sensor for providing a signal representative of the location of the listener head, and logical circuitry responsive to said listener head location signal for actuating said vertically adjustable mounting to position said electroacoustical transducers at a predetermined vertical position related to the listener head location.

* * * * *

UNITED STATES PATENT AND TRADEMARK OFFICE

CERTIFICATE OF CORRECTION

PATENT NO. : 7,187,777 B1
APPLICATION NO. : 08/440073
DATED : March 6, 2007
INVENTOR(S) : Richard E. Saffran It is certified that error appears in the above-identified patent and that said Letters Patent is hereby corrected as shown below:

Column 7, line 11, “stimulating” should read --simulating--.
Column 7, line 15, “loudspeakers” should read --loudspeaker--.
Column 7, line 24, “forwarded” should read --forward--.

Signed and Sealed this

Fifth Day of June, 2007

JON W. DUDAS
*Director of the United States Patent and Trademark Office*